US005291257A

United States Patent [19]

Cerrah et al.

[11] Patent Number: 5,291,257

[45] Date of Patent: Mar. 1, 1994

[54] COMPOSITE PRESSURE ROLL

[75] Inventors: Kenneth M. Cerrah, Webster; Jerome P. Chasko, Williamson; Stacey R. Moss, Webster; Raymond J. McQuade, Ontario, all of N.Y.

[73] Assignee: Xerox Corporation, Stamford, Conn.

[21] Appl. No.: 100,781

[22] Filed: Aug. 2, 1993

[51] Int. Cl.[5] ..... G03G 15/20

[52] U.S. Cl. ..... 355/290; 219/216; 355/282; 432/60

[58] Field of Search ..... 355/282, 285, 290, 295; 432/60; 219/216; 492/46, 56; 428/421, 422

[56] References Cited

U.S. PATENT DOCUMENTS 3,988,817 11/1976 Thettu ..... 492/56
4,196,256 4/1980 Eddy et al. ..... 428/422
4,199,626 4/1980 Stryjewski et al. ..... 432/60 X

FOREIGN PATENT DOCUMENTS 61-236575 10/1986 Japan .
63-73281 4/1988 Japan .

*Primary Examiner*—A. T. Grimley
*Assistant Examiner*—William J. Royer

[57] ABSTRACT

A pressure roll that forms a fusing nip with a fuser roll in a fusing system has a core and a surface coating having been heat cured from a composition of a fluorocarbon polymer and an irregularly shaped, nonplanar, inert filler having a hardness greater than 8 Mohs, the filler having a nominal particles size of from about 10 to 30 microns and being present in the cured surface coating in an amount of from about 10% to 40% by weight of the total solids weight of the coating.

17 Claims, 1 Drawing Sheet

COMPOSITE PRESSURE ROLL

BACKGROUND OF THE INVENTION

The present invention relates to a composite pressure roll useful in a fusing system in an electrostatographic reproducing apparatus. In particular, it relates to a long life pressure roll which is capable of functioning in a fusing system wherein toner images are fused on a variety of substrates including transparencies.

In a typical electrostatographic reproducing apparatus, a light image of an original to be copied is recorded in the form of an electrostatic latent image upon a photosensitive member and the latent image is subsequently rendered visible by the application of electroscopic thermoplastic resin particles which are commonly referred to as toner. The visible toner image is then in a loose powdered form and can be easily disturbed or destroyed. The toner image is usually fixed or fused upon a support which may be the photosensitive member itself or other support sheet such as plain paper.

One of the more common approaches to thermal fusing of toner images is with the application of heat and pressure concurrently by various means such as a roll pair including a heated fuser roll and pressure roll which are maintained in pressure contact through a fusing nip. The fusing of the toner particles takes place when the proper combination of heat, pressure and contact time are provided. In the fusing operation it is important that no offset of the toner particles from the substrate to the fuser member takes place during normal operations. Any particles so offset may subsequently transfer to other parts of the machine or onto the support in subsequent copying cycles thereby increasing the background or interfering with the material being copied. To ensure and maintain good release properties of the toner from the fuser roll it has become customary to apply release agents to the fuser roll during the fuser operation. These typically are materials applied as thin films, for example, silicone oils to prevent toner offset. In some fusing systems which require the use of substantial quantities of release agent inevitably some release agent is transferred to the pressure roll from the fusing roll. The presence of release agents such as silicone oil can impair the reliable feeding of transparencies through the fuser because with the transfer of the release agent from the fusing roll to the pressure roll, the friction between the pressure roll and the transparency is insufficient to drive the transparency through the fusing nip. When the transparency actually stalls within the fusing nip it can then create a jam within the machine presenting a serious reliability problem which may require a serviceman to repair. In addition, although the transparency might not actually become stalled in the fusing nip it's trajectory through the transport path may be altered so that it can create a jam further downstream in the transport path.

It has previously been proposed to solve this problem by increasing the roughness of the surface of the pressure roll to provide additional frictional forces by manually or machine sanding the surface of the pressure roll during its manufacture to thereby provide adequate feeding of transparencies. However, when plain paper is fed or transported through the fuser nip it quickly wears away the roughened pressure roll surface to a smooth surface and the copier performance once again deteriorates to the point where it does not feed transparencies reliably. In addition, the roughened pattern formed by the manual or machine sanding of the surface, which typically is done in a pattern such as a helical pattern, interferes with the duplex capability of the printer in that the pattern on the pressure roll may be offset to the printed first copy side of the duplex print.

PRIOR ART

U.S. Pat. No. 3,912,901 to Strella et al. describes a backup pressure roll for use in a fusing system which has a rigid core covered with a relatively thick elastomeric layer with a relatively thinner layer or sleeve of a copolymer or of perfluoroalkyl perfluorovinylether with tetrafluoroethylene.

SUMMARY OF THE INVENTION

Accordingly, the present invention is directed to providing a long life pressure roll having a roughened surface and thereby providing frictional forces to provide improved long life feeding of transparencies through the nip in the fuser system.

In a principle aspect of the present invention the fuser system has a heated fuser roll and a backup pressure roll forming a fusing nip therebetween for fusing a toner image to a substrate with the pressure roll having a core and a surface coating having been heat cured from a composition comprising a liquid fluorocarbon polymer and an irregularly shaped, nonplanar, inert filler having a hardness greater than 8 Mohs, said filler having a nominal particle size of from about 10 to 30 microns and being present in said cured surface coating in an amount of from about 10% to about 40% by weight of the total solids weight of the coating.

In a further aspect of the present invention the liquid fluorocarbon polymer is a blend of polytetrafluoroethylene and perfluoroethylene perfluoroalkyl vinylether polymer.

In a further aspect of the present invention the filler is selected from the group consisting of alumina and silicon carbide and mixtures thereof.

In a further aspect of the present invention the filler has a nominal particle size of about 20 microns and is present in an amount of from about 25% to about 30% by weight of the total solids weight of the coating.

In a further aspect of the present invention the filler is fused alumina.

In a further aspect of the present invention the surface coating on the pressure roll has a coefficient of friction of at least 0.31 per ASTM D4518, Method A.

DETAILED DESCRIPTION OF THE PRESENT INVENTION

Figure 1:
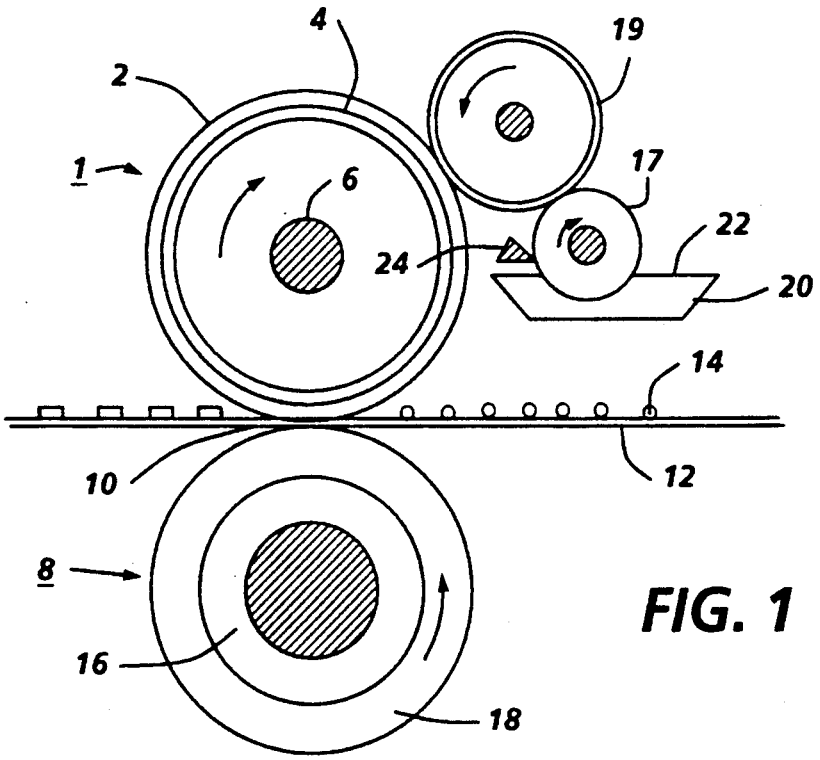
FIG. 1 is a sectional view of a fuser system which may use the pressure roll of the present invention.

A typical fuser member of the present invention is described in conjunction with a fuser assembly as shown in FIG. 1 where the numeral 1 designates a fuser roll comprising elastomer surface 2 upon suitable base member 4 which is a hollow cylinder or core fabricated from any suitable metal such as aluminum, anodized aluminum, steel, nickel, copper, and the like, having a suitable heating element 6 disposed in the hollow portion thereof which is coextensive with the cylinder. Backup or pressure roll 8 cooperates with fuser roll 1 to form a fusing nip or contact arc 10 through which a copy paper or other substrate 12 passes such that toner images 14 thereon contact elastomer surface 2 of fuser roll 1. As shown in FIG. 1, the backup roll 8 has a rigid steel core 16 with an elastomer surface or layer 18 thereon. Sump 20 contains polymeric release agent 22 which may be a solid or liquid at room temperature, but it is a fluid at operating temperatures.

In the embodiment shown in FIG. 1 for applying the polymeric release agent 22 to elastomer surface 2, two release agent delivery rolls 17 and 19 rotatably mounted in the direction indicated are provided to transport release agent 22 from the sump 20 to the elastomer surface. As illustrated in FIG. 1, roll 17 is partly immersed in the sump 20 and transports on its surface release agent from the sump to the delivery roll 19. By using a metering blade 24 a layer of polymeric release fluid can be applied initially to delivery roll 19 and subsequently to elastomer 2 in controlled thickness ranging from submicrometer thickness to thickness of several micrometers of release fluid. Thus, by metering device 24, about 0.1 to 2 micrometers or greater thickness of release fluid can be applied to the surface of elastomer 2.

As described with reference to U.S. Pat. No. 3,912,901 the pressure roll comprises a substrate core which is preferably rigid, although in some instances it may be somewhat flexible but typically takes the form of a cylindrical tube which may be made from a stainless steel, aluminum and the like and has a surface layer which may be relatively thin. The pressure roll may also have an intermediate layer between the core and surface layer such as a relatively thick resilient material such as an elastomer.

Any suitable liquid fluorocarbon polymer may be used in forming the surface coating on the pressure roll. Preferably the polymer is a liquid to provide a homogeneous mix during fabrication of the pressure roll and result in the homogeneous film build up on the roll. Typical liquid fluorocarbon polymers that may be used in the practice of the present invention include polytetrafluoroethylene (PTFE) perfluoroethylene perfluoroalkylvinylether (PFA) and mixtures thereof. Typical commercially available materials include the liquid polymers available from E. I. DuPont under the product designations: 851-224 (PTFE), 857-200 (PFA) and 855-401 (PTFE and PFA).

A material that has been found to be particularly effective in the practice of the present invention is a blend of polytetrafluoroethylene (PTFE) and perfluoroalkyl perfluorovinyl ether (PFA) available from E. I. DuPont deNemours, Co., Inc., Wilmington, Del. under the product designation 855-401. This material is believed to contain polytetrafluoroethylene, perfluoroethylene perfluoroalkylvinylether polymer, acrylic polymer, oleic acid, octylphenoxypolyethoxyethanol surfactant, diethylene glycol monobutyl ether, water, triethanolamine and an aromatic hydrocarbon. It contains about 43.54% by weight solids and 56.46% by weight volatile material which comprises about 73.80% by volume. The polymer blend is believed to be primarily polytetrafluoroethylene (PTFE) with a small amount about 10% by weight perfluoroalkyl perfluorovinyl ether (PFA).

Any suitable filler material may be used in the practice of the present invention. It is selected to provide the necessary roughness and coefficient of friction on the surface of the pressure roll to enable long term feeding of a variety of substrates, including transparencies, through the fuser nip. Accordingly, it should be irregular in shape and nonplanar to provide the necessary roughness and coefficient of friction. In addition, it should have a hardness greater than 8 Mohs to ensure long life. It should also be corrosion resistant so that it will not rust and lose a portion of it's surface and hardness characteristics. It should also be relatively inert by which we mean nonreactive with the fluorocarbon polymer, any other additives or the release agent. It is important that the filler material not be too small so that it does not supply sufficient friction nor too large so as to become abrasive to the substrates passing through the fusing nip. Accordingly, we have found a range of filler from 10 to 30 microns of average particle size and preferably about 20 microns to provide the desired characteristics. In addition to the size, the filler should be present in a weight ratio of the surface coating of from about 10 to 40% by solids weight and preferably 25 to 30% by solids weight to provide the preferred friction and physical integrity of the coating film. In this connection the term "by solids weight" means total weight of coating minus the volatiles. Optimum results in obtaining friction characteristics and physical integrity are achieved at about 28% by weight of filler by weight of the total weight of the surface coating on the pressure roll. While any suitable filler may be used in the practice of the present invention, alumina (fused and calcined), and in particular, fused alumina and silicon carbide are preferred, with the fused alumina being most preferred as it provides exceptional performance and is far more economical than silicon carbide. A particularly preferred filler in achieving exceptional functional results, is the fused alumina available from Buehler Ltd., Malvern, Pa. under the formulation 40-6620-200-080. This fused alumina is about 97% pure with about 2% by weight titanium dioxide and small amounts of silicon dioxide, ferric oxide and sodium oxide and has an average particle size diameter of 20 microns. An alternative fused alumina is that available from Fujimi Corporation, Elmhurst, Ill. under the designation PAW-30, A-600. A typical silicon carbide useful in the practice of the present invention is that available from Fujimi under the designation GC-600. The type, size and amount of filler used in the practice of the present invention should be such as to provide a coefficient of friction of at least about 0.31 as measured by ASTM D4518, Method A. This test measures coefficient of friction against polished steel.

The pressure roll, according to the present invention may be fabricated with conventional manufacturing processes and conventional spray processes with liquid polymers. Typically, the metal substrate such as a steel or aluminum substrate is degreased in conventional manner with conventional solvents such as aqueous cleaners or trichloroethylene. This is followed by grit blasting to roughen the surface with a 46 grit alumina to provide 120–180 microinch Ra roughened surface on steel. With an aluminum substrate 80 grit alumina is used to provide the 120 to 180 Ra roughened surface. A primer such as DuPont's 850-314 which contains polytetrafluoroethylene polymer, chromium oxide, sodium lauryl sulfate, toluene and water and the additive VM-7799, which is an acid mixture of phosphoric acid and chromic acid may then be applied to the grit blasted substrate and permitted to dry in air. The surface coating of the pressure roll can also be prepared in conventional manner by pouring the polymer into a vessel, adding the filler with stirring and preferably roller mixing to ensure uniform suspension of the filler in the polymer after which it is filtered through a 50 mesh or finer filter and finally sprayed onto the primed substrate to a 1.5 to 2 mil. film in one or multiple passes. This is followed by drying in ambient air for 20 to 30 minutes and a two step cure baking process of 20 minutes at about 375° F. followed by 25 minutes at about 820° F. The coated pressure roll is polished on a lathe rotating at about 1000 rpm with 600 grit sand paper to provide a finished roughness of about 50 microinches Ra roughness.

The following Examples further define and describe fuser members prepared by the present invention and illustrate preferred embodiment of the present invention. Unless otherwise indicated, all parts and percentages are by weight. Example III is for comparison purposes.

EXAMPLE I

A coated pressure roll according to the present invention was prepared according to the above general procedure as follows: A steel tube Grade 118, 40 millimeters in diameter was degreased with 1,1,1 trichloroethylene followed by grit blasting with 46 grit Norton Dynablast aluminum oxide to a surface roughness of Ra=120±20 microinch under air pressure of 80 psi while being rotated in a fixture at 44 rpm for one 45 second pass. The core was removed from the fixture and sprayed with dry filtered air to clean the surface. The cleaned grit blasted steel core was placed in a rotator device in a spray booth and rotated and a liquid primer DuPont 850-314 together with 32 parts by weight per 100 parts by weight primer of an additive VM-7799, a mixture of phosphoric acid and chromic acid was sprayed on the core with a DeVilbiss JGA-502 spray gun to provide a dry primer film 0.2 to 0.35 mil. thickness with one pass. The composite coating was prepared by adding 20 micron particle size fused alumina (Buehler Ltd., formulation 40-6620-200-080) to a liquid blend of polytetrafluoroethylene and perfluoroethylene perfluoroalkylvinylether polymer (DuPont PTFE/PFA Liquid Coating 855-401) in an amount to provide 28.6% alumina by weight of the solids content of the paint. The alumina powder was dispersed into the paint by stirring with a spatula for about one minute followed by roller mixing to ensure uniform suspension of the alumina in the paint. The primed core was placed in a rotator device in a spray booth and rotated. The composite coating was sprayed onto the primed steel core with a DeVilbiss JGA-502 spray gun to provide a dry film 1.2 to 2 mil. in thickness with two passes. The coated roll was dried in ambient air for about 20 minutes after which it was cured by being placed in an oven preheated to 820° F. for a residence time of 10 minutes after the roll metal temperature reached 780° F. preferably with a peak temperature around 800° F. The roll was then removed from the oven and permitted to cool to ambient conditions (70° F. at 40% relative humidity). The cooled roll was placed in a lathe and polished at about 1000 rpm in two passes over the roll with 600 grit sandpaper to a surface roughness of about 50 microinches. The unpolished roll had a surface roughness of about 100–120 microinches.

The composite pressure roll was placed in the fusing system of a Xerox 5775 plain paper copier for evaluation and was found to provide acceptable performance for at least 300,000 prints for a variety of substrates including transparencies as well as ordinary paper. This same testing including the same general mix of substrates including transparencies was conducted for 14 rolls in Xerox 5775 copiers with acceptable performance being achieved for an average of 300,000 prints per roll before termination of the test.

EXAMPLE II

Another roll was prepared in the same way except that the filler was 25 micron silicon carbide (Fujimi GC-500) present in an amount to provide 25% by weight of the solids content of the paint. The same testing as in Example I with a variety of substrates was conducted in a Xerox 5775 for 3 rolls and acceptable fusing performance was achieved for an average of 10,000 prints per roll before failure for reasons other than inability to feed transparencies.

EXAMPLE III

By comparison the present pressure roll in the Xerox 5775 plain paper copier which is prepared with the same substrate and primer as in Example I but has a top coat of polytetrafluoroethylene (DuPont 851-224) applied by conventional spraying techniques in multiple spray applications with two to three bakes in between applications to a thickness of 6 to 8 mils followed by turning in a lathe to provide the desired profile and sanding with 180 grit sandpaper to provide a surface roughness of 150±20 microinches when used as the pressure roll in the fusing system in the Xerox 5775 and with the same general mix of substrates including transparencies almost 100% of rolls failed at an average of about 60,000 prints by failing to perform acceptably with transparencies.

Thus, according to the present invention a long life pressure roll has been provided and one which is capable of feeding substrates of a variety of kinds, including transparencies, with an increased life of from about 60,000 prints to at least 300,000 prints and providing an increase in life of at least 300% and generally of the order of 500%. In addition, the manufacturing cost is reduced by eliminating the hand or machine grinding step. Furthermore, in view of the improved reliability in the feeding of transparencies, costs are further reduced in that unscheduled maintenance calls are avoided. In addition, the invention enables duplex capability in that the pattern formed during the sanding process is no longer present on the roll.

All the patents and applications referred to herein are hereby specifically, and totally incorporated herein by reference in their entirety in the instant specification.

While the invention has been described in detail with reference to specific and preferred embodiments, it will be appreciated that various modifications and variations will be apparent to the artisan. While the present invention has been described as a pressure roll, it will be understood in certain applications it may have utility as a fuser member or donor member. All such modifications and embodiments as may readily occur to one skilled in the art are intended to be within the scope of the appended claims.

We claim:

1. A pressure roll that forms a fusing nip with a fuser roll in a fusing system, said pressure roll comprising a core and a surface coating having been heat cured from a composition comprising a liquid fluorocarbon polymer and an irregularly shaped, nonplanar, inert filler having a hardness greater than 8 Mohs, said filler having a nominal particle size of from about 10 to 30 microns and being present in said cured surface coating in an amount of from about 10% to 40% by weight of the total solids weight of the coating.

2. The pressure roll of claim 1, wherein said liquid fluorocarbon polymer is a blend of polytetrafluoroethylene and perfluoroethylene perfluoroalkylvinylether polymer.

3. The pressure roll of claim 1 wherein said filler is selected from the group consisting of alumina and silicon carbide and mixtures thereof.

4. The pressure roll of claim 3 wherein said filler has a nominal particle size of about 20 microns and is present in an amount of from about 25% to 30% by weight of the total solids weight of the coating.

5. The pressure roll of claim 4 wherein said filler is fused alumina.

6. The pressure roll of claim 4 wherein said filler is silicon carbide.

7. The pressure roll of claim 1 wherein said surface coating has a coefficient of friction of at least 0.31.

8. The pressure roll of claim 1 wherein said core is a substantially cylindrical metal member.

9. A fusing system comprising a heated fuser roll and a backup pressure roll forming a fusing nip therewith for fusing a toner image to a substrate, said pressure roll comprising a core and a surface coating having been heat cured from a composition comprising a liquid fluorocarbon polymer and an irregularly shaped, nonplanar, inert filler having a hardness greater than 8 Mohs, said filler having a nominal particle size of from about 10 to 30 microns and being present in said cured surface coating in an amount of from about 10% to 40% by weight of the total solids weight of the coating.

10. The fusing system of claim 9 further including a release agent donor system for delivering release agent to said fuser roll.

11. The fusing system of claim 9 wherein said liquid fluorocarbon polymer is a blend of polytetrafluoroethylene and perfluoroethylene perfluoroalkylvinylether polymer.

12. The fusing system of claim 9 wherein said filler is selected from the group consisting of alumina and silicon carbide and mixtures thereof.

13. The fusing system of claim 12 wherein said filler has a nominal particle size of about 20 microns and is present in an amount of from about 25% to 30% by weight of the total solids weight of the coating.

14. The fusing system of claim 13 wherein said filler is fused alumina.

15. The fusing system of claim 13 wherein said filler is silicon carbide.

16. The fusing system of claim 9 wherein said surface coating has a coefficient of friction of at least 0.31.

17. The fusing system of claim 9 wherein said core is a substantially cylindrical metal member.

* * * * *